US007555927B2

(12) United States Patent
Hanafusa et al.

(10) Patent No.: US 7,555,927 B2
(45) Date of Patent: Jul. 7, 2009

(54) BOTTLE-SHAPED CAN MANUFACTURING METHOD AND BOTTLE-SHAPED CAN

(75) Inventors: Tatsuya Hanafusa, Gotenba (JP); Ryoichi Ito, Gotenba (JP); Masahiro Hosoi, Gotenba (JP); Takashi Hasegawa, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 18 days.

(21) Appl. No.: 11/577,471

(22) PCT Filed: Mar. 11, 2005

(86) PCT No.: PCT/JP2005/004327

§ 371 (c)(1),
(2), (4) Date: Apr. 18, 2007

(87) PCT Pub. No.: WO2006/043347

PCT Pub. Date: Apr. 27, 2006

(65) Prior Publication Data

US 2008/0069665 A1 Mar. 20, 2008

(30) Foreign Application Priority Data

Oct. 20, 2004 (JP) ..... 2004-305533

(51) Int. Cl.
*B21D 22/26* (2006.01)
*B21D 51/00* (2006.01)

(52) U.S. Cl. ..... 72/349; 72/379.4; 72/715

(58) Field of Classification Search ..... 72/348, 72/349, 379.4, 715, 405.03, 97
See application file for complete search history.

(56) References Cited

U.S. PATENT DOCUMENTS 5,557,963 A * 9/1996 Diekhoff ..... 72/379.4
5,893,286 A 4/1999 Johnson et al.

FOREIGN PATENT DOCUMENTS

JP 2000-515072 A 11/2000
JP 2004-123231 A 4/2004
JP 2004123231 A * 4/2004
JP 2004-250063 A 9/2004

OTHER PUBLICATIONS

International Search Report for PCT/JP2005/004327 mailed May 10, 2005.

* cited by examiner

*Primary Examiner*—Dana Ross
*Assistant Examiner*—Debra M Sullivan
(74) *Attorney, Agent, or Firm*—Darby & Darby P.C.

(57) ABSTRACT

In a bottle-shaped can manufacturing method and a bottle-shaped can, a necking process is performed on an opening portion of a cylindrical workpiece with a bottom several times to form a body, a shoulder, and a portion for forming a neck that is continuously connected to an upper end of the shoulder in the axial direction of the bottle-shaped can and extends upward, and a first convex is formed in at least one of a connection portion between the shoulder and the portion for forming the neck and a connection portion between the shoulder and the body. Then, the shoulder is pressed to the inside of the body while the first convex is recessed inward in the radial direction, thereby forming grooves in the shoulder.

8 Claims, 9 Drawing Sheets

FIG. 5

| | r (mm) | α (°) | h (mm) | L1 (mm) | a1 (mm) | a2 (mm) | L2 (mm) | θ (rad) | a1/r | EVALUATION | H |
|---|---|---|---|---|---|---|---|---|---|---|---|
| n=24 | 33.1 | 28 | 22.75 | 25.77 | 8.67 | 5.48 | 44.40 | 0.12 | 0.13 | × | 39.2 |
| n=22 | 33.1 | 28 | 22.75 | 25.77 | 9.45 | 5.98 | 44.33 | 0.13 | 0.14 | △ | 39.1 |
| n=20 | 33.1 | 28 | 22.75 | 25.77 | 10.40 | 6.57 | 44.24 | 0.15 | 0.16 | ○ | 39.1 |
| n=18 | 33.1 | 28 | 22.75 | 25.77 | 11.55 | 7.29 | 44.12 | 0.17 | 0.17 | ○ | 39.0 |
| n=16 | 33.1 | 28 | 22.75 | 25.77 | 13.00 | 8.20 | 43.96 | 0.19 | 0.20 | ○ | 38.8 |
| n=14 | 33.1 | 28 | 22.75 | 25.77 | 14.86 | 9.35 | 43.73 | 0.21 | 0.22 | ○ | 38.6 |
| n=12 | 33.1 | 28 | 22.75 | 25.77 | 17.33 | 10.87 | 43.37 | 0.25 | 0.26 | ○ | 38.3 |
| n=10 | 33.1 | 28 | 22.75 | 25.77 | 20.80 | 12.98 | 42.79 | 0.30 | 0.31 | ○ | 37.8 |
| n=8 | 33.1 | 28 | 22.75 | 25.77 | 26.00 | 16.08 | 41.75 | 0.39 | 0.39 | △ | 36.9 |
| n=6 | 33.1 | 28 | 22.75 | 25.77 | 34.66 | 21.00 | 39.62 | 0.54 | 0.52 | × | 35.0 |

BOTTLE-SHAPED CAN MANUFACTURING METHOD AND BOTTLE-SHAPED CAN

CROSS REFERENCE TO PRIOR APPLICATIONS

This is a U.S. national phase application under 35 U.S.C. §371 of International Patent Application No. PCT/JP2005/004327, filed Mar. 11, 2005, and claims benefit of Japanese Patent Application No. 2004-305533, filed on Oct. 20, 2004, both of them are incorporated by reference in its entirety. The International Application was published in Japanese on Apr. 27, 2006 as International Publication No. WO/2006/043347 under PCT Article 21(2).

FIELD OF THE INVENTION

The present invention relates to a bottle-shaped can manufacturing method and a bottle-shaped can.

BACKGROUND

In general, aluminum cans have been used to contain beverages. However, in recent years, bottle-shaped cans with screw caps have been proposed. In general, the bottle-shaped can includes a large body, a shoulder whose diameter gradually decreases from a lower end to an upper end of the body, and a neck extending from the upper end of the shoulder upward, and a cap is engaged with a male screw formed on the neck.

The bottle-shaped can is formed by performing a DI process on a metal plate to form a cylindrical workpiece with a bottom, performing a necking process on an opening portion of the cylindrical workpiece several times to form a body, a shoulder, and a portion for forming a neck that is continuously connected to an upper end of the shoulder and extends upward, and performing, for example, a drawing process, a screw shaping process, and a curl forming process on the cylindrical workpiece.

In recent years, in order to appeal to consumers, this type of bottle-shaped can has needed to be changed so as to have various shapes with a high-quality design. In the related art, for example, printing or emboss processing has been used to manufacture the bottle-shaped can. The emboss process is disclosed in, for example, in JP-A-2004-123231 and JP-T-2000-515072.

JP-A-2004-123231 discloses the following method: a cylindrical mold having an inner circumferential surface that is formed substantially in the same shape as that of a shoulder, and a plurality of pressure portions, each extending substantially in the inclined direction of the shoulder, that are formed in the circumferential direction on the inner circumferential surface so as to protrude inward in the radial direction is arranged so as to coaxially face the opening portion of a cylindrical workpiece with the bottom; and, the mold and the cylindrical workpiece with the bottom are moved close to each other in the axial direction of the cylindrical workpiece with the bottom such that the opening portion of the cylindrical workpiece with the bottom is inserted into the mold and the pressure portions are pressed against the shoulder, thereby forming in the circumferential direction the plurality of grooves extending in the inclined direction of the shoulder.

JP-T-2000-515072 discloses the following method a first rotating body and a second rotating body are supported such that they can be rotated on their rotational axes parallel to each other; the first rotating body is arranged inside a cylindrical workpiece with a bottom and the second rotating body is arranged outside the cylindrical workpiece with a bottom; and the first and second rotating bodies are moved close to each other and are rotated on their rotational axes, with a body of the cylindrical workpiece interposed between outer circumferential portions of the first and second rotating bodies, thereby performing emboss processing on the body (forming convex and concave portions).

In the manufacturing method disclosed in JP-T-2000-515072, since the emboss processing is performed with the inner and outer circumferential surfaces of the body interposed between the first and second rotating bodies, it is possible to accurately form the concave and convex portions in the body. That is, when the body is interposed between the outer circumferential portions of the first and second rotating bodies, the convex portions formed in the outer circumferential surface of the second rotating body in the axial direction are fitted into the concave portions formed in the outer circumferential surface of the first rotating body in the axial direction with the body interposed therebetween. That is, metal forming the body is prevented from flowing in the circumferential direction, and the body is recessed inward in the radial direction. Therefore, the convex portions on the second rotating body can be accurately transferred onto the body.

However, in the manufacturing method disclosed in JP-A-2004-123231, the pressure portions of the mold are only pressed against the outer circumferential surface of the shoulder, but no pressure is applied to the inner circumferential surface of the shoulder, which makes it difficult to accurately form the grooves. That is, when the pressure portions of the mold are pressed against only the outer circumferential surface of the shoulder without pressing the inner circumferential surface of the shoulder, metal flow occurs in the shoulder in both the circumferential direction and the axial direction, which causes both portions of the shoulder pressed by the pressure portions and peripheral portions to be recessed to the inside of the body. As a result, it is difficult to form grooves having steep side walls in the outer circumferential surface of the shoulder and thus for the groove to be clearly viewed.

In order to solve the above-mentioned problems, the manufacturing method disclosed in JP-T-2000-515072 has been proposed in which a mold is also arranged inside the shoulder, and the shoulder is interposed between the mold provided inside the shoulder and a mold for pressing the outer circumferential surface of the shoulder. However, as described above, in a bottle-shaped can having a body, a shoulder that is connected to an upper end of the body and is tapered upward, and a neck that has a small diameter and extends from the upper end of the shoulder upward, it is difficult to arrange the mold inside the shoulder, and thus it is difficult to use this manufacturing method for this type of bottle-shaped can.

SUMMARY OF THE INVENTION

The present invention provides a bottle-shaped can capable of appealing to consumers and a method of accurately manufacturing the bottle-shaped can.

According to an aspect of the invention, there is provided a method of manufacturing a bottle-shaped can including a body having a large diameter, a shoulder that is continuously connected to an upper end of the body in an axial direction of the body and is tapered upward, a neck that is continuously connected to an upper end of the shoulder in the axial direction and extends upward, and a cap that is engaged with a male screw formed on the neck. The method includes: performing a necking process on an opening portion of a cylindrical workpiece with a bottom and the body several times to form the body, the shoulder, and a portion for forming the neck that is continuously connected to the upper end of the shoulder in the axial direction and extends upward; forming a first convex in at least one of a connection portion between the shoulder and the portion for forming the neck and a connection portion between the shoulder and the body such that the first convex protrudes outward in a radial direction from the entire circumference of the connection portion; pressing a line linking the upper end to the lower end of the shoulder in a direction in which the shoulder is inclined to the inside of the body to form, in a circumferential direction of the shoulder, a plurality of grooves extending in the inclined direction; pressing a lower end of the line with a mold surface having a triangular shape, with one vertex of the triangular mold surface disposed at the lower end of the line; and pressing a point on the line where the first convex is disposed to be recessed inward in the radial direction.

In this structure, since the first convex is recessed inward in the radial direction to form the grooves, it is possible to prevent portions of the first convex that are not pressed from being recessed inward in the radial direction due to the deformation of the first convex recessed inward in the radial direction. That is, it is possible to make the portions of the first convex that are not recessed have resistance to pressure applied to the inside of the bottle-shaped can, that is, a protruding force toward the outside of the bottle-shaped can in the radial direction. In this way, it is possible to manufacture a bottle-shaped can having grooves with steep side walls in the outer circumferential surface of the shoulder. As a result, it is possible to improve the quality of design of the bottle-shaped can.

When the grooves are formed, the first convex can prevent metal forming at least one of the body and the portion for forming the neck from flowing to the shoulder or into the grooves, which makes it possible to form the grooves having a large depth and to prevent at least one of the portions for forming the neck and the body from being wrinkled.

Further, since the triangular mold surface is pressed against the lower end of the shoulder to form the grooves, it is possible to reliably prevent the body from being wrinkled.

Further, since the line of the shoulder is pressed to form the groove, it is possible to form grooves in the shoulder in a straight line in the inclined direction of the shoulder.

In this way, it is possible to form a bottle-shaped can having a high-quality design.

Furthermore, instead of this structure, a necking process may be performed on an opening portion of a cylindrical workpiece with a bottom and a body several times to form the body, the shoulder, and a portion for forming a neck that is continuous with an upper end of the shoulder in the axial direction of the cylindrical workpiece and extends upward, and a thick portion protruding outward from the body may be formed in at least one of the upper end and the lower end of the shoulder. As such, the thick portion of the shoulder may be pressed to the inside of the body to form grooves extending in a direction in which the shoulder is inclined.

The first convex may be formed in the connection portion between the shoulder and the portion for forming the neck, and the line may link the recessed portion of the first convex to the portion pressed by the one vertex of the triangular mold surface in the direction in which the shoulder is inclined.

According to the above-mentioned structure, it is possible to reliably form grooves extending in the direction in which the shoulder is inclined.

After the shoulder and the portion for forming the neck are formed, a portion from the upper end of the shoulder to the lower end of the portion for forming the neck may be pressed inward in the radial direction such that the width of the portion is reduced, thereby forming the first convex in the connection portion between the shoulder and the portion for forming the neck. As such, the shoulder may be pressed to the inside of the body while the first convex is being pressed inward in the radial direction, thereby forming the grooves.

According to the above-mentioned structure, since the first convex is pressed inward in the radial direction to form the grooves in the circumferential direction of the shoulder, it is possible to easily form the grooves without lowering the roundness of the neck. That is, the first convex is formed after theneckingg process. Therefore, even when the roundness of the portion for forming the neck is lowered due to the necking process, it is possible to correct the lowered roundness and thus to prevent the lowering of the roundness of the portion for forming the neck.

When the first convex is pressed to the inside of the body, relatively low pressure is applied to the shoulder, starting from the recessed first convex, so that the groove is formed from the upper end to the lower end of the shoulder in the inclined direction. For example, when the cylindrical workpiece with the bottom is formed by a DI process, it is possible to easily and accurately form the grooves and to prevent the body from being bent when the grooves are formed, due to the alignment of metal crystals of the cylindrical workpiece W formed by the DI process.

A cylindrical mold having an inner circumferential surface that is formed substantially in the same shape as that of the shoulder and a plurality of pressure portions, each extending substantially in the inclined direction of the shoulder, that are formed in the circumferential direction on the inner circumferential surface so as to protrude inward in the radial direction may be arranged so as to coaxially face the opening portion of the cylindrical workpiece with the bottom. Then, the mold and the cylindrical workpiece with the bottom may be moved close to each other in the axial direction of the cylindrical workpiece with the bottom such that the opening portion of the cylindrical workpiece with the bottom is inserted into the mold and the pressure portions are pressed against the shoulder, thereby forming in the circumferential direction the plurality of grooves satisfying the following Expression:

$$L1=h/\cos\alpha,$$

$$a1=2\cdot r\cdot sin(360°/(2\cdot n)),$$

$$a2=2\cdot\sin(360°/(2\cdot n))\cdot(r-h\cdot\tan\alpha),$$

$$L2=a2\cdot L1/(a1-a2), \text{ and}$$

$$\theta=2\cdot a\sin(a2/2\cdot L),$$

where L1: the length of the shoulder in the inclined direction, a1: the width of a lower end of the groove in the axial direction of the bottle-shaped can, a2: the width of an upper end of the groove in the axial direction of the bottle-shaped can, L2: the distance between the upper end of the shoulder in the axial direction of the bottle-shaped can and an intersection point between two extension lines of both ends of the groove in the circumferential direction that extend upward in the axial direction of the bottle-shaped can, n: the number of grooves ($8 \leqq n \leqq 22$), r: the radius of an outer circumferential surface of the body, h: the length of the shoulder in the axial direction of the bottle-shaped can, and α: an angle formed between the axis of the bottle-shaped can and the outer circumferential surface of the shoulder.

According to the above-mentioned structure, since the groove is formed so as to satisfy the above-mentioned Expression, it is possible to reliably form a bottle-shaped can having a high-quality design.

That is, when the number of grooves is larger than 22, the gap between adjacent pressure portions is reduced in the mold, and a change in the shape of the shoulder is limited by the pressure portions when the grooves are formed, which makes it difficult to appropriately adjust the depth and length of the groove (in the direction in which the shoulder is inclined). On the other hand, when the number of grooves is smaller than 8, the groove shape is not formed, which makes it difficult to form a bottle-shaped can having a high-quality design.

After the grooves are formed, a drawing process may be performed on a part of the portion for forming the neck other than the lower end in the axial direction to reduce the diameter of the part, thereby forming a second convex protruding outward in the radial direction at the lower end of the portion for forming the necking the axial direction.

According to the above-mentioned structure, after the grooves are formed, the second convex is formed, which makes it possible to correct the roundness of the portion for forming the neck even when the roundness of the portion for forming the neck is lowered due to the formed grooves.

After the first convex is formed, a drawing process may be performed on a part of the portion for forming the neck other than the lower end in the axial direction to reduce the diameter of the part, thereby forming a second convex protruding outward in the radial direction at the lower end of the portion for forming the necking the axial direction, and thereafter the grooves are formed.

According to the above-mentioned structure, since the second convex is formed before the grooves are formed, it is possible to improve the rigidity of the portion for forming the neck against pressure applied when the grooves are formed, and to prevent the roundness of the portion for forming the neck from being lowered when the grooves are formed. In addition, even when pressure applied to the shoulder is transmitted to the portion for forming the neck during the formation of the grooves, the second convex makes it possible to prevent the portion for forming the neck from being wrinkled due to the transmitted pressure.

The grooves may be formed under the condition such that the internal pressure of the bottle-shaped can is in the range of 0.05 MPa to 0.70 MPa.

According to the above-mentioned structure, it is possible to prevent the body from being bent.

According to another aspect of the invention, a bottle-shaped can includes: a body that has a large diameter; a shoulder that is continuously connected to an upper end of the body in an axial direction of the body and is tapered upward; a neck that is continuously connected to an upper end of the shoulder in the axial direction and extends upward; and a cap that is engaged with a male screw formed on the neck. The bottle-shaped can is formed by the above-mentioned bottle-shaped can manufacturing method. A portion of the groove other than the lower end in the direction in which the shoulder is inclined is formed in a V shape in sectional view in a direction orthogonal to the axis of the bottle-shaped can, and the lower end of the groove in the inclined direction has a triangular shape as viewed from the outside in a radial direction. In addition, one of three vertexes of the triangle is disposed at an upper end in the inclined direction and a lower end of the V-shaped bottom in the inclined direction, and the remaining two vertexes are disposed at both ends of the lower end of the shoulder in the inclined direction.

According to the above-mentioned structure, since the grooves formed in the outer circumferential surface of the shoulder each have steep side walls, the grooves can be clearly viewed, which makes it possible to provide a bottle-shaped can having a high-quality design.

In the above-mentioned bottle-shaped can manufacturing method, a bottle-shaped can manufacturing apparatus including a holding portion for holding the bottom of the cylindrical workpiece and a tool holding portion having a plurality of shaping tools for forming the cylindrical workpiece into various shapes may be prepared. Then, the manufacturing apparatus may sequentially perform various processes on the cylindrical workpiece with the bottom by using the shaping tools to form a bottle-shaped can. In this case, a cylindrical mold having an inner circumferential surface that is formed substantially in the same shape as that of the shoulder and a plurality of pressure portions, each extending substantially in the inclined direction of the shoulder, that are formed in the circumferential direction on the inner circumferential surface so as to protrude inward in the radial direction is provided as one of the shaping tools. The mold is arranged so as to coaxially face the opening portion of the cylindrical workpiece with the bottom, and the mold and the cylindrical workpiece with the bottom are moved close to each other in the axial direction of the cylindrical workpiece with the bottom such that the opening portion of the cylindrical workpiece with the bottom is inserted into the mold and the pressure portions are pressed against the shoulder, thereby forming the grooves.

According to the above-mentioned structure, it is possible to form the plurality of grooves on the entire circumferential surface of the shoulder at once and thus to improve productivity. In addition, since a uniform load can be applied to the entire circumferential surface of the shoulder, it is possible to minimize a reduction in the roundness of the portion for forming the neck.

According to the above-described aspects of the invention, it is possible to provide a bottle-shaped can having a high-quality design.

BRIEF DESCRIPTION OF THE DRAWINGS

FIG. 5 is a table illustrating the dimensions of portions of the bottle-shaped can shown in FIG. 4.

DETAILED DESCRIPTION OF EMBODIMENTS OF THE INVENTION

Figure 1A:
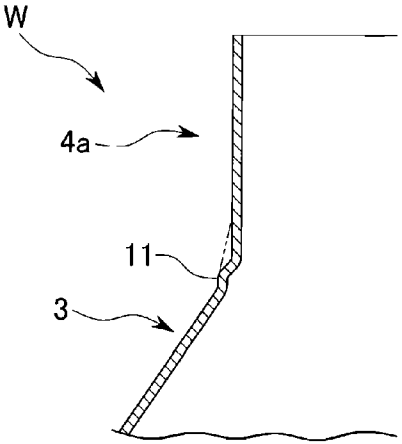
FIGS. 1A to 1D are partial sectional side views illustrating an opening portion of a cylindrical workpiece with a bottom in various processes of a bottle-shaped can manufacturing method according to an embodiment of the invention.

Hereinafter, exemplary embodiments of the invention will be described with reference to the accompanying drawings. However, the invention is not limited to the following embodiments, and components of the embodiments may be combined with each other.

First, a bottle-shaped can 1 to be formed will be described with reference to FIG. 2.

The bottle-shaped can 1 is formed of, for example, aluminum or aluminum alloy, and includes a body 2 having a large diameter, a shoulder 3 that is connected to the upper end of the body 2 in the axial direction of the bottle-shaped can and is tapered upward, and a neck 4 that is connected to the upper end of the shoulder 3 in the axial direction of the bottle-shaped can and extends upward. A male screw portion 5 is formed on the neck 4, and a cap (not shown) is engaged with the male screw portion 5.

Further, a protruding portion 6 protruding in the radial direction is continuous with the lower end of the male screw portion 5 in the axial direction of the bottle-shaped can. The protruding portion 6 includes a large-diameter portion whose diameter increases downward, a top portion, which is a convex portion in the radial direction, and a tapered portion whose diameter decreases downward, which are formed in this order from the top to the bottom of the protruding portion 6. A small-diameter portion 8 is continuous with a lower end of the tapered portion having a small diameter in the axial direction of the bottle-shaped can, and a second convex portion 7 having a smaller diameter than the protruding portion 6 is continuous with a lower end of the small-diameter portion 8.

The upper end of the neck 4 in the axial direction of the bottle-shaped can is a curl portion 9 that is bent in the radial direction. In this way, the neck 4 has the curl portion 9, the male screw portion 5, the protruding portion 6, the small-diameter portion 8, and the second convex 7 formed in this order from the top to the bottom thereof in the axial direction of the bottle-shaped can. The neck 4 is smoothly connected to the shoulder 3 through the second convex 7.

Figure 3:
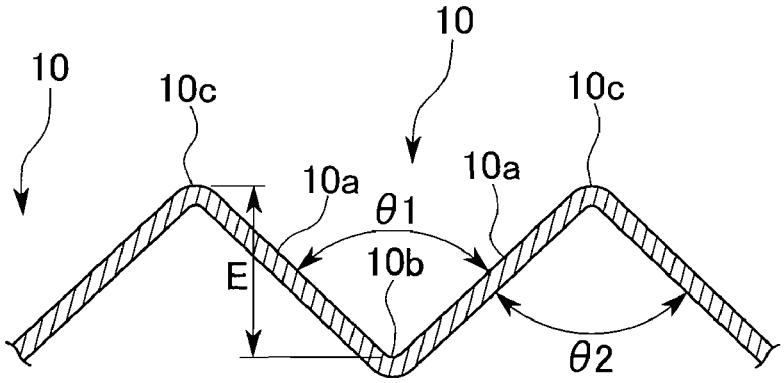
FIG. 3 is an enlarged sectional view illustrating a portion of a groove shown in FIG. 2.

A plurality of grooves 10 extending in a direction in which the shoulder 3 is inclined are formed in the shoulder 3 in the circumferential direction that is continuous with the lower end of the second convex 7 in the axial direction of the bottle-shaped can. As shown in FIG. 3, the groove 10 according to this embodiment extends in the direction in which the shoulder 3 is inclined, and the width (the size in the circumferential direction) of the groove 10 gradually increases from the upper end to the lower end thereof in the inclined direction.

In addition, the groove 10 includes an upper end 10*d*, a lower end 10*e*, a bottom portion 10*b* recessed in the radial direction, and two side walls 10*a* that extend from both sides of the bottom portion 10*b* in the circumferential direction and protrude to the outside in the radial direction. In this way, a portion of the shoulder 3 in the inclined direction thereof other than the upper end 10*d* and the lower end 10*e* has a V shape in sectional view that is orthogonal to the axis of the bottle-shaped can. Therefore, the plurality of grooves 10 are connected to each other in the circumferential direction of the shoulder 3 through their top portions 10*c* protruding toward the outside in the radial direction.

The upper end 10*d* of the groove 10 is inclined such that the depth E thereof gradually decreases upward, and the lower end 10*e* of the groove 10 is inclined such that the depth E thereof gradually decreases downward. That is, the displacement of the upper end 10*d* of the groove 10 gradually increases downward, and the displacement of the lower end 10*e* of the groove 10 gradually increases upward.

Figure 2:
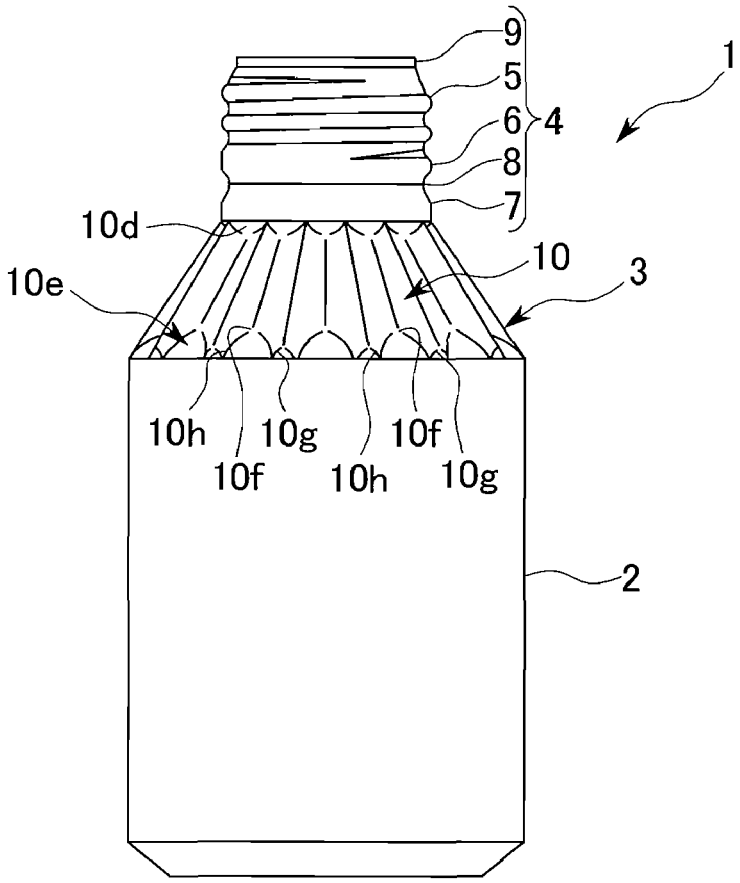
FIG. 2 is a side view illustrating a bottle-shaped can manufactured by the bottle-shaped can manufacturing method according to an embodiment of the invention.
Figure 4:
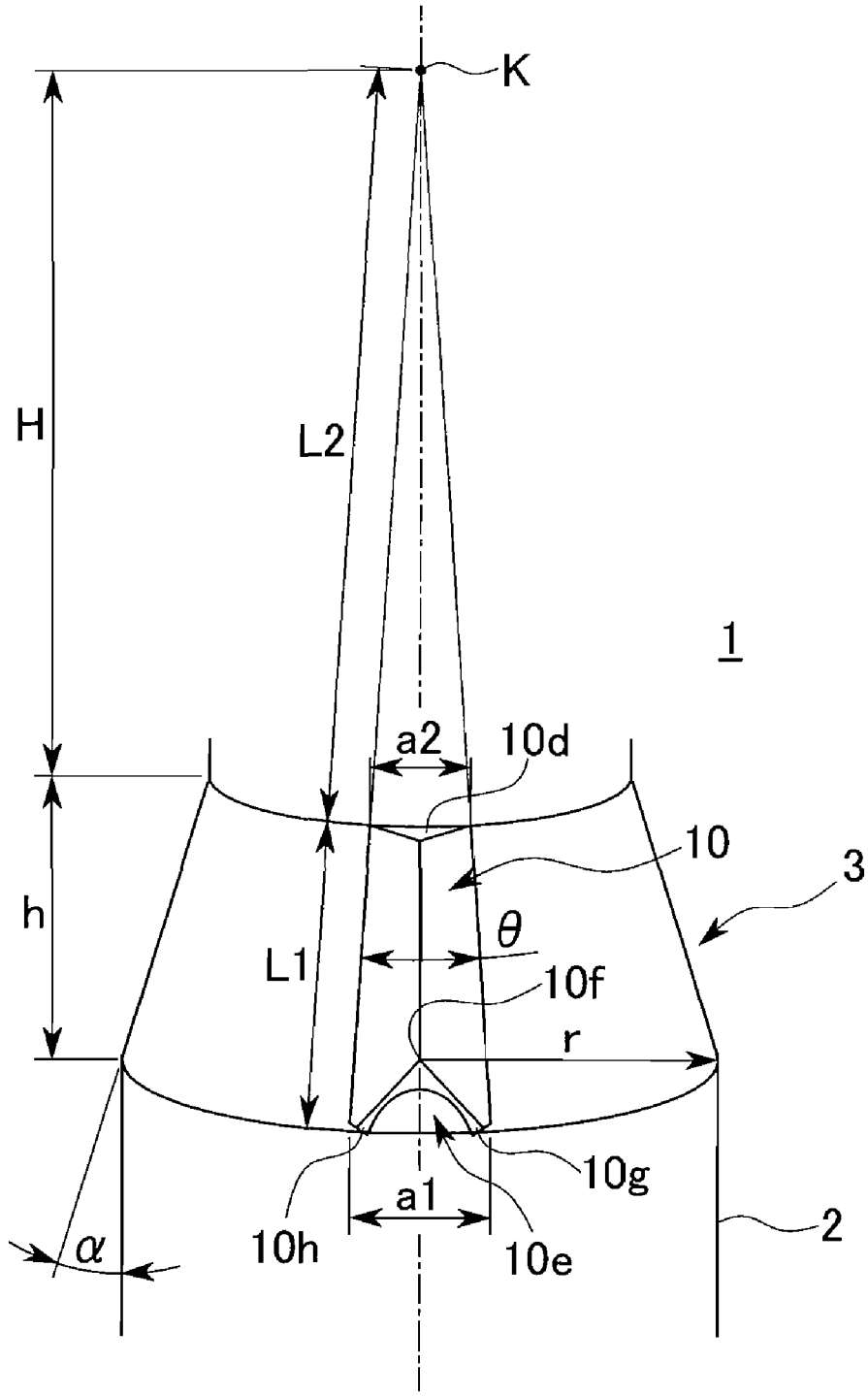
FIG. 4 is a partial perspective view illustrating the bottle-shaped can shown in FIG. 2.

As shown in FIGS. 2 and 4, the lower end 10*e* of the groove 10 has a triangular shape in side view, as viewed from the outside in the radial direction, and the triangular shape has three vertexes 10*f*, 10*g*, and 10*h*. Among the three vertexes, the vertex 10*f* is disposed at the top of the triangle in the inclined direction and is also disposed at the lower end of the V-shaped bottom portion 10*b* in the inclined direction, and the two vertexes 10*g* and 10*h* are disposed at both sides of the triangle in the circumferential direction of the shoulder 3.

The groove 10 having the above-mentioned structure is formed such that the size thereof shown in FIG. 4 satisfies the following Expression:

$$L1=h/\cos\alpha,$$

$$a1=2\cdot r\cdot\sin(360°/(2\cdot n)),$$

$$a2=2\cdot\sin(360°/(2\cdot n))\cdot(r-h\cdot\tan\alpha),$$

$$L2=a2\cdot L1/(a1-a2), \text{ and}$$

$$\theta=2\cdot a\sin(a2/2\cdot L)$$

where L1: the length of the shoulder 3 in the inclined direction, a1: the width of a lower end of the groove 10 in the axial direction of the bottle-shaped can, a2: the width of an upper end of the groove 10 in the axial direction of the bottle-shaped can, L2: distance between the upper end of the shoulder 3 in the axial direction of the bottle-shaped can and an intersection point K between two extension lines of both ends (the top portions 10*c*) of the groove in the circumferential direction that extend upward in the axial direction of the bottle-shaped can, n: the number of grooves ($8 \leqq n \leqq 22$), r: the radius of the outer circumferential surface of the body 2, h: the length of the shoulder 3 in the axial direction of the bottle-shaped can, and α: an angle formed between the axis of the bottle-shaped can and the outer circumferential surface of the shoulder 3.

FIG. 5 shows the values of L1, a1, a2, L2, and θ calculated by the above-mentioned Expression according to the number of grooves 10. As shown in FIG. 3, the depth E of the groove 10, that is, the distance E between the outer surface of the top portion 10*c* and the outer surface of the bottom portion 10*b* in a direction orthogonal to the inclined direction of the shoulder 3 is in the range of 0.1 mm to 4.0 mm. The curvature radius of the outer surface of the top portion 10*c* is in the range of 0.13 mm to 0.80 mm, and the curvature radius of the outer surface of the bottom portion 10*b* is in the range of 0.13 mm to 0.80 mm. In addition, the thicknesses of the side wall 10*a*, the bottom portion 10*b*, and the top portion 10*c* of the groove 10 are in the range of 0.1 mm to 0.25 mm.

In the bottle-shaped can 1 in which the distance H from the intersection point K to the top end of the shoulder 3 in the axial direction is about 38.6 mm, the length h of the shoulder 3 in the axial direction is about 22.75 mm, the angle θ formed between the axis of the bottle-shaped can and the outer circumferential surface of the shoulder 3 is about 28°, and the number of grooves 10 is 14, an angle θ1 (see FIG. 3) between the outer circumferential surfaces of the side walls 10*a* adjacent to each other in the circumferential direction in the groove 10 that is at a distance of 43 mm from the intersection point K downward in the axial direction of the bottle-shaped can is 161°. The angle θ1 between the outer circumferential surfaces of the side walls 10*a* in the groove 10 that is at a distance of 50 mm from the intersection point K downward in the axial direction of the bottle-shaped can is 166°. The angle θ1 between the outer circumferential surfaces of the side walls 10*a* in the groove 10 that is at a distance of 53 mm from the intersection point K downward in the axial direction of the bottle-shaped can is 165°. The angle θ1 between the outer circumferential surfaces of the side walls 10*a* in the groove 10 that is at a distance of 55 mm from the intersection point K downward in the axial direction of the bottle-shaped can is 166°.

In the bottle-shaped can 1, an angle θ2 (see FIG. 3) between the inner circumferential surfaces of the side walls 10*a* adjacent to each other in the circumferential direction in the groove 10 that is at a distance of 43 mm from the intersection point K downward in the axial direction of the bottle-shaped can is 140°. The angle θ2 between the inner circumferential surfaces of the side walls 10*a* in the groove 10 that is at distances of 50 mm, 53 mm, and 55 mm from the intersection point K downward in the axial direction of the bottle-shaped can is 144°.

In the bottle-shaped can 1 in which the distance H from the intersection point K to the top end of the shoulder 3 in the axial direction is about 38.6 mm, the length h of the shoulder 3 in the axial direction is about 22.75 mm, the angle α formed between the axis of the bottle-shaped can and the outer circumferential surface of the shoulder 3 is about 28°, and the number of grooves 10 is 16, the angle θ1 between the outer circumferential surfaces of the side walls 10*a* in the groove 10 that is at a distance of 43.2 mm from the intersection point K downward in the axial direction of the bottle-shaped can is 159°. The angle θ1 between the outer circumferential surfaces of the side walls 10*a* in the groove 10 that is at distances of 50.2 mm, 53.2 mm, and 55.2 mm from the intersection point K downward in the axial direction of the bottle-shaped can is 162°.

In this bottle-shaped can 1, the angle θ2 between the inner circumferential surfaces of the side walls 10*a* in the groove 10 that is at a distance of 43.2 mm from the intersection point K downward in the axial direction of the bottle-shaped can is 141°. The angle θ2 between the inner circumferential surfaces of the side walls 10*a* in the groove 10 that is at distances of 50.2 mm and 53.2 mm from the intersection point K downward in the axial direction of the bottle-shaped can is 144°. The angle θ2 between the inner circumferential surfaces of the side walls 10*a* in the groove 10 that is at a distance of 55.2 mm from the intersection point K downward in the axial direction of the bottle-shaped can is 143°.

As can be seen from the results, the angles θ1 and θ2 of the groove 10 are maintained at substantially constant values over the overall length of the shoulder 3 in the inclined direction.

Figure 6:
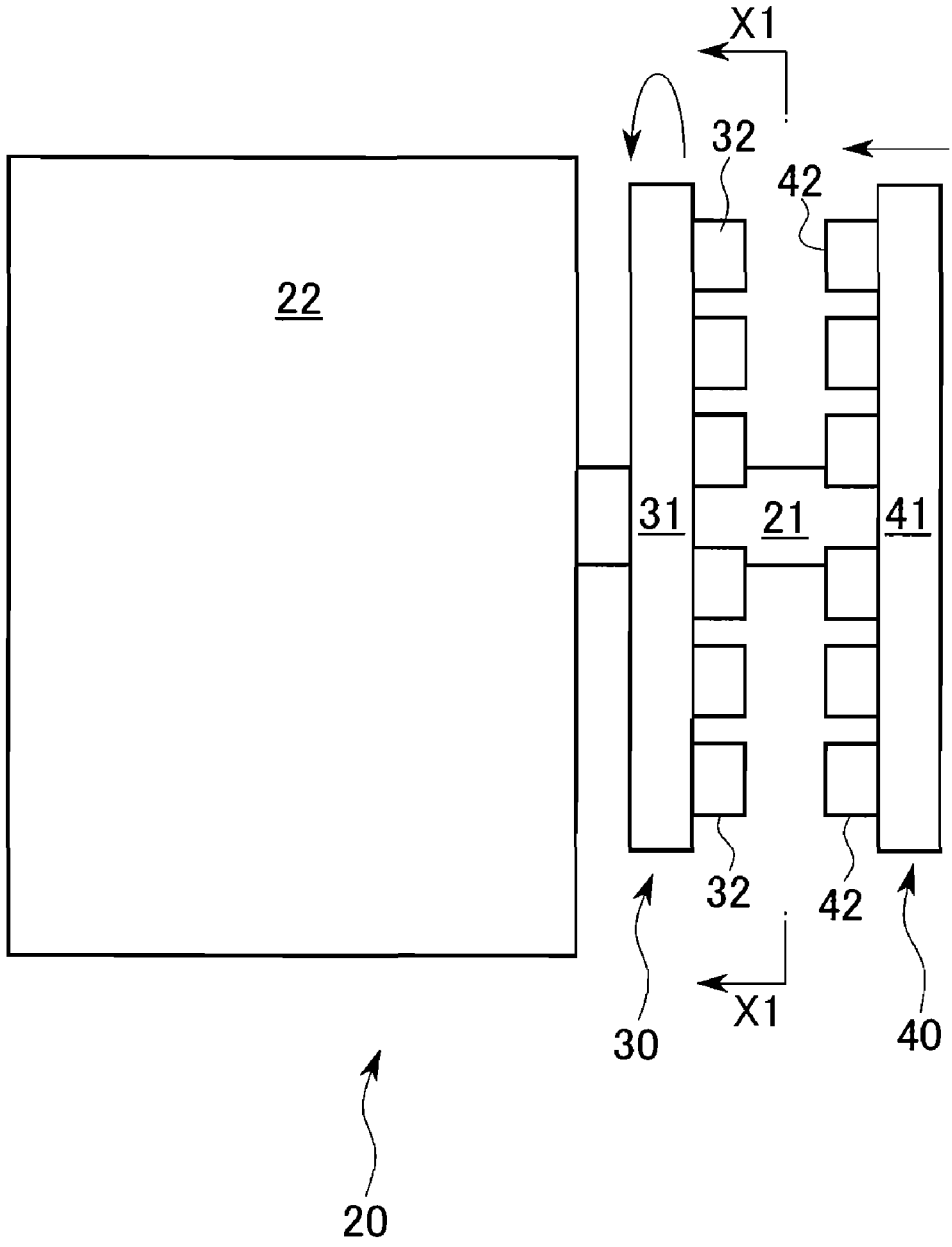
FIG. 6 is a side view illustrating a bottle-shaped can manufacturing apparatus for performing the bottle-shaped can manufacturing method shown in FIG. 1.

Next, a method of manufacturing the bottle-shaped can 1 having the above-mentioned structure will be described. In FIG. 6, a bottle-shaped can manufacturing apparatus 20 includes a workpiece holding portion 30 for holding a cylindrical workpiece W having a bottom, a tool holding portion 40 that holds a shaping tool 42 for shaping the cylindrical workpiece W having a bottom, and a driving unit 22 for driving the two holding portions 30 and 40. The holding portions 30 and 40 are arranged such that a workpiece holding surface for holding the cylindrical workpiece W faces a tool holding surface for holding the shaping tool 42. The cylindrical workpiece W having the bottom is formed by performing a DI process on a metal plate.

Figure 7:
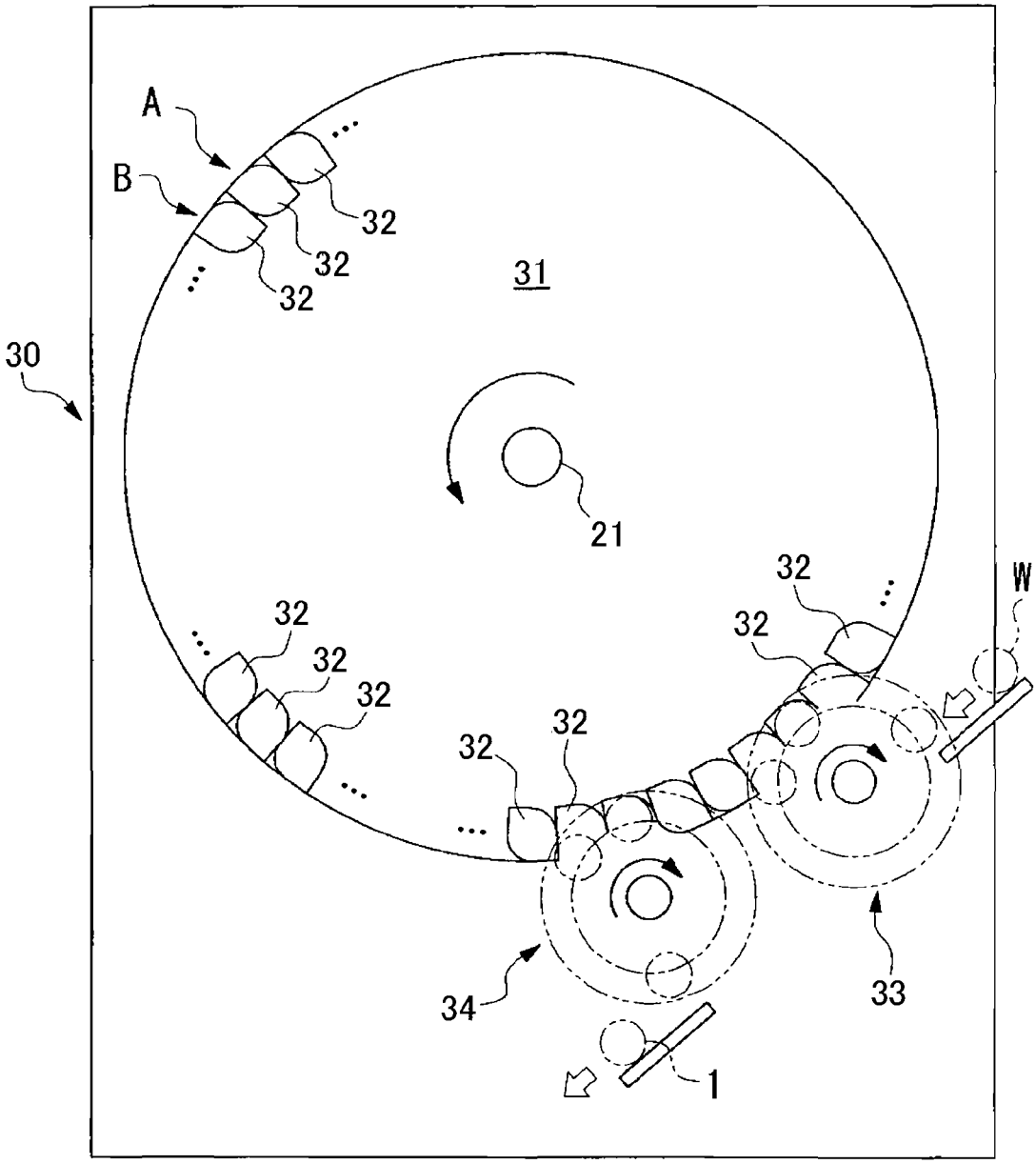
FIG. 7 is a cross-sectional view taken along the line X1-X1 of FIG. 6 showing the bottle-shaped can manufacturing apparatus.

As shown in FIG. 7, in the workpiece holding portion 30, a plurality of holding members 32 for holding the cylindrical workpiece W are arranged in a circularshape on the surface of a disk 31 supported by a shaft 21 that faces the tool holding portion 40. When the disk 31 is intermittently rotated by the driving unit 22, the cylindrical workpiece W having the bottom is supplied to the holding member 32 from a supply portion 33, and the formed bottle-shaped cans 1 are sequentially discharged from a discharge portion 34. The holding member 32 holds a portion of the cylindrical workpiece W from the bottom to a lower part of the body in the axial direction of the cylindrical workpiece. In addition, not all of the plurality of holding members 32 provided in the circumference of the disk 31 are shown in FIG. 7, but some of them are shown in FIG. 7.

In the tool holding portion 40, a plurality of various types of shaping tools 42 are arranged in a circular shape on the surface of a disk 41 supported by a shaft 21 that faces the workpiece holding portion 30. The disk 41 is configured to move in the axial direction of the shaft 21 by the driving unit 22. The tool holding portion 40 is provided with a plurality of shaping tools 42 for performing various shaping processes, such as a plurality of drawing molds for reducing the diameter of an opening portion of the cylindrical workpiece W having the bottom (a necking process), a groove forming mold 50, which will be described later, for forming the grooves 10 in the shoulder 3, a screw forming tool for forming the male screw portion 5 on the neck 4, and a curl forming tool for forming the curl portion 9 at the end of the opening portion, and these shaping tools 42 are arranged in a circular shape on the disk 41 in the order of processes.

When the tool holding portion 40 is moved to the left side of FIG. 6, the cylindrical workpieces W held by the workpiece holding portion 30 are processed by the shaping tools 42.

The workpiece holding portion 30 (the disk 31) is intermittently rotated on the shaft 21 such that the axes of the cylindrical workpieces W with opening portions facing the tool holding portion 40 are identical with the central axes of the individual shaping tools 42. When the disk 31 is intermittently rotated by the driving unit 22, each cylindrical workpiece W having the bottom is moved to a position opposite to the next shaping tool 42, and is then processed by the shaping tool 42.

That is, when the tool holding portion 40 is moved close to the workpiece holding portion 30, the cylindrical workpieces W each having the bottom are processed by the corresponding shaping tools 42. When the tool holding portion 40 is separated from the workpiece holding portion 30, the workpiece holding portion 30 is rotated such that the shaping tools 42 for the next processes face the cylindrical workpieces W. In this way, the approach/separation of the tool holding portion 40 to/from the workpiece holding portion 30 and the rotation of the workpiece holding portion 30 are repeatedly performed to form the shoulder 3, the neck 4, and the grooves 10 in the cylindrical workpiece W having the bottom, thereby manufacturing the bottle-shaped can 1.

Figure 8:
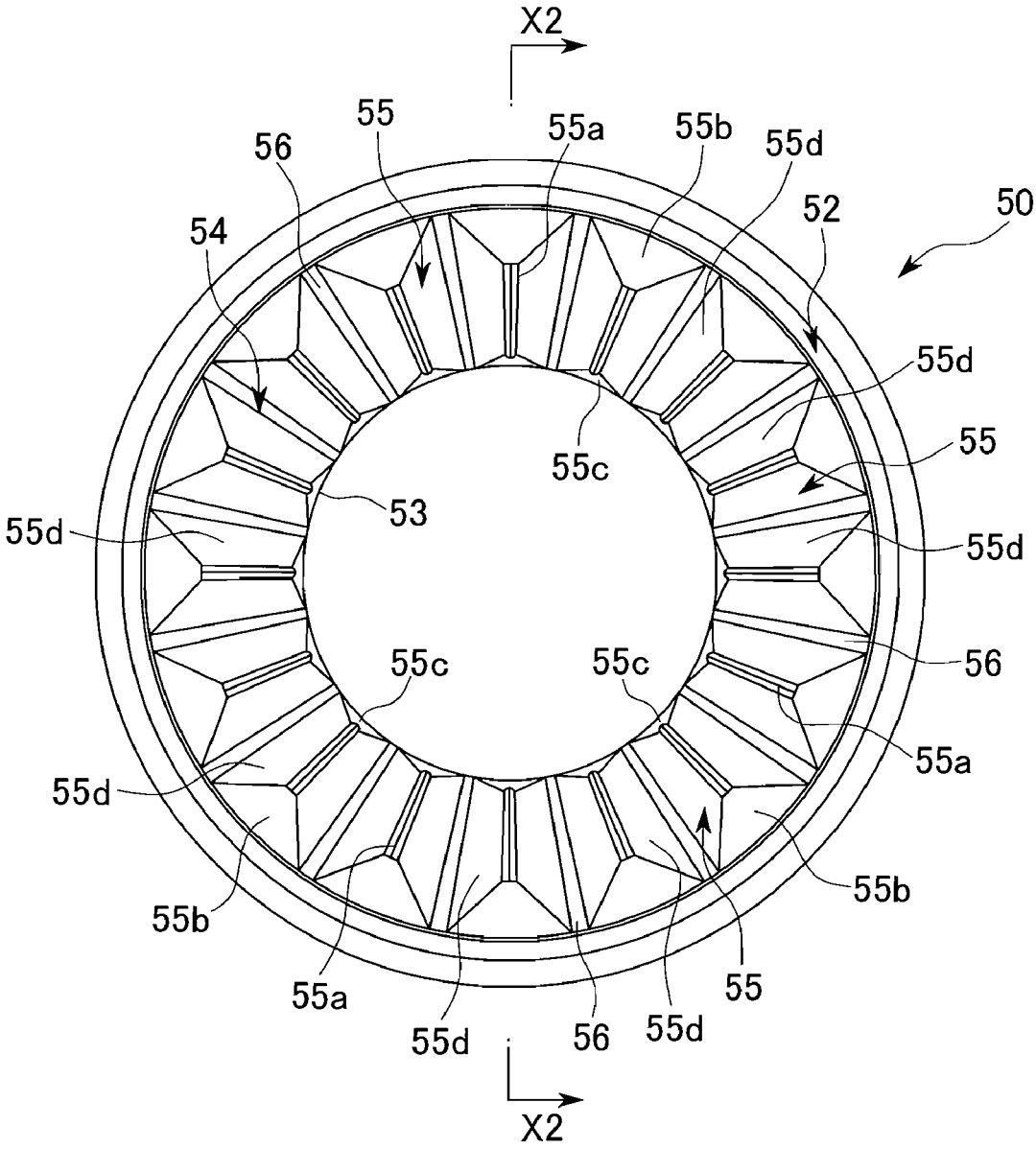
FIG. 8 is a plan view illustrating a groove forming mold, which is one of the shaping tools provided in a tool holding portion shown in FIG. 6.
Figure 9:
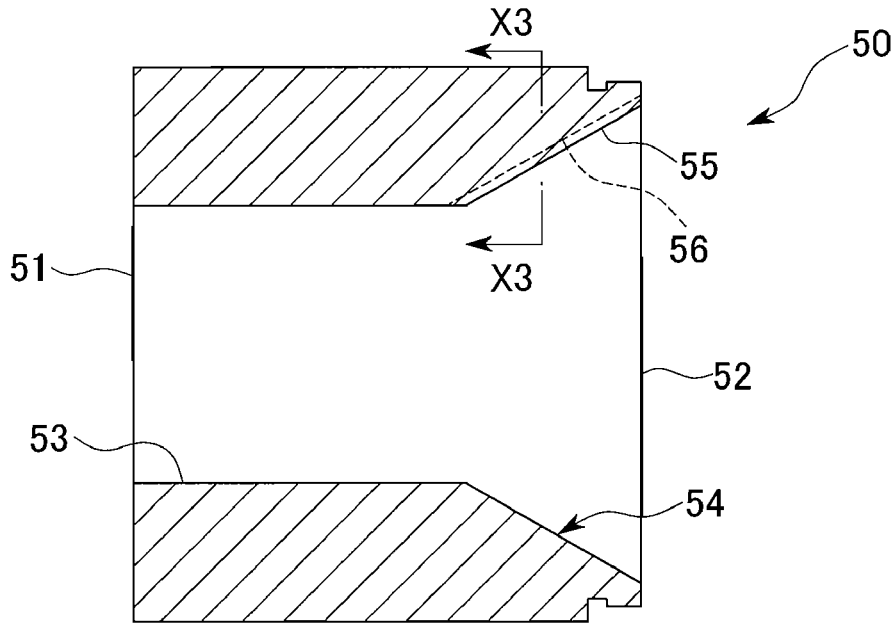
FIG. 9 is a cross-sectional view taken along the line X2-X2 of FIG. 8 showing the groove forming mold.

As shown in FIGS. 8 and 9, a groove forming mold 50 is formed in a cylindrical shape, and the inner surface of the groove forming mold 50 includes an inner circumferential portion 53 that extends from one end 51 of the mold 50 to the other end 52 substantially in parallel to the central axis of the groove forming mold 50 and a taper portion 54 whose diameter gradually increases from the one end 51 to the other end 52.

The inner circumferential portion 53 and the taper portion 54 are connected to each other such that the surface of the inner circumferential portion 53 opposite to the one end 51 and the surface of the taper portion 54 opposite to the other end 52 have the same axis. In addition, the inner diameter of the taper portion 54 opposite to the other end 52 is substantially equal to the inner diameter of the inner circumferential portion 53 opposite to the one end 51.

Figure 10:
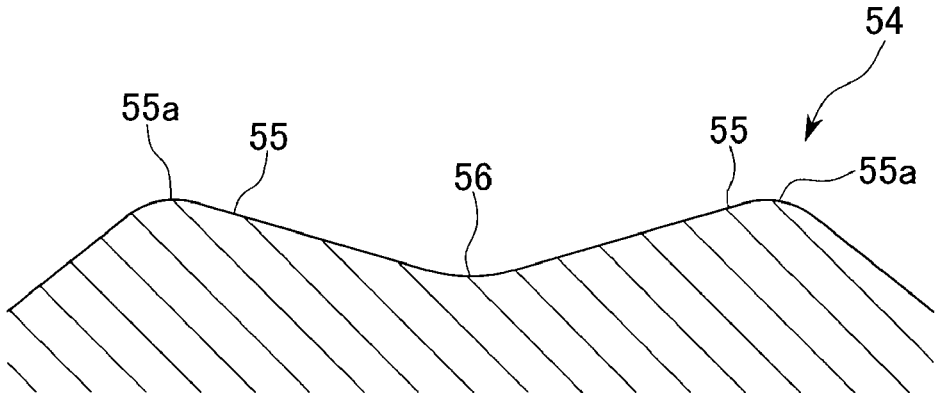
FIG. 10 is a cross-sectional view taken along the line X3-X3 of FIG. 9 showing the groove forming mold.

The taper portion 54 has substantially the same shape as the shoulder 3. As shown in FIGS. 8 and 10, a plurality of pressure portions 55 that protrude inward in the radial direction and extend in the inclined direction are formed on the surface of the taper portion 54 at predetermined gaps in the circumferential direction.

As shown in FIGS. 8 and 10, the pressure portion 55 is formed in a triangular shape in a sectional view orthogonal to the axis line of the groove forming mold 50. One side of the triangle forms a circumferential surface of the taper portion 54, and the remaining two sides are ascending wall surfaces 55*d* ascending inward from the circumferential surface in the radial direction of the mold 50. An intersection between the wall surfaces 55*d* is a top portion 55*a* of the pressure portion 55.

A concave portion 56 is provided between the pressure portions 55 adjacent to each other in the circumferential direction. An end of the pressure portion 55 (a mold surface; hereinafter, referred to as a leading end 55*b*) disposed at the other end 52 of the mold 50 is inclined from the circumferential surface of the taper portion 54 of the mold 50 toward the one end 51. That is, the height of the leading end 55*b* of the pressure portion 55 gradually decreases toward the other end 52 of the mold 50. The leading end 55*b* has a triangular shape in plan view as viewed from the axial direction of the groove forming mold 50, and among three vertexes of the triangle, two vertexes are disposed at the other end 52 of the groove forming mold 50.

The other end of the pressure portion 55 (hereinafter, referred to as a rear end 55*c*) disposed at the one end 51 of the mold 50 is inclined from the circumferential surface of the taper portion 54 of the mold 50 toward the other end 52. That is, the height of the rear end 55*c* of the pressure portion 55 gradually decreases toward the one end 51 of the mold 50. The rear end 55*c* has a triangular shape in plan view as viewed from the axial direction of the groove forming mold 50, and among three vertexes of the triangle, two vertexes are disposed at the one end 51 of the groove forming mold 50.

Further, the height of the pressure portion 55 protruding from the circumferential surface of the taper portion 54 gradually decreases from the leading end 55*b* to the rear end 55*c*. An angle between the two ascending wall surfaces 55*d* forming the pressure portion 55 and an angle between the ascending wall surfaces 55*d*, opposite to each other, of the pressure portions adjacent to each other in the circumferential direction of the taper portion 54 gradually increase from the one end 51 of the mold 50 toward the other end 52.

In the above-mentioned structure, as described above, the tool holding portion 40 is moved toward the workpiece holding portion, with the one end 51 of the groove forming mold 50 held by the surface of the tool holding portion 40 (the disk 41) and the other end 52 facing the opening portion of the cylindrical workpiece W having the bottom. Then, the opening portion of the cylindrical workpiece W having the bottom is inserted into the mold 50 through the other end 52 in the taper portion 54, and the entire surface of the pressure portion 55 including the top portion 55*a*, the leading end 55*b*, and the rear end 55*c* is pressed against the shoulder 3 to form the grooves 10.

Next, a method of manufacturing the bottle-shaped can 1 shown in FIGS. 2 and 3 by using the bottle-shaped can manufacturing apparatus 20 having the above-mentioned structure will be described below.

First, as shown in FIG. 7, the cylindrical workpiece W having the bottom is supplied to the holding member 32 by the supply portion 33 and is then held by the holding member 32. Then, the disk 31 is intermittently rotated such that the cylindrical workpiece W faces one shaping tool 42 provided on the tool holding portion 40.

Subsequently, the intermittent rotation of the disk 31 and the forward/backward movement of the tool holding portion 40 are repeated to perform a necking process on the opening portion of the cylindrical workpiece W having the bottom several times (for example, 20 times), thereby gradually reducing the diameter of the opening portion. In this way, the body 2, the shoulder 3, and a portion 4*a* for forming the neck 4, which is continuous with the upper end of the shoulder 3 in the axial direction of the cylindrical workpiece W and extends in the vertical direction, are formed.

Thereafter, pressure is applied to a portion from the lower end of the portion 4*a* to the upper end of the shoulder 3 inward in the radial direction at a position A shown in FIG. 7 to reduce the diameter of that portion, thereby forming a first convex 11 (see FIG. 1A) protruding outward in the radial direction along the entire circumference of a connection portion between the shoulder 3 and the portion 4*a*. That is, the first convex 11, which is a thick portion, protruding outward from the body of the bottle-shaped can (outward in the radial direction) is formed at the upper end of the shoulder 3. The thick portion means a portion of the shoulder 3 on which a relatively large amount of metal is concentrated. For example, the thickness of the thick portion is larger than the average thickness of the shoulder portion 3.

The first convex 11 shown in FIG. 1A protrudes from both the shoulder 3 and the portion 4*a* for forming the neck formed in the radial direction.

Figure 1B:
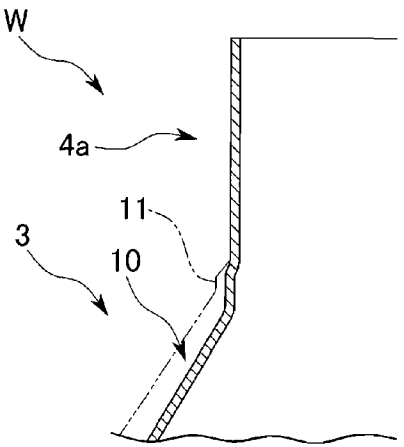

Then, the disk 31 is rotated to dispose the cylindrical workpiece W having the bottom at a position B that faces the groove forming mold 50 shown in FIG. 7. Subsequently, the tool holding portion 40 is moved toward the disk 31, with the internal pressure of the cylindrical workpiece W kept in the range of 0.05 MPa to 0.70 MPa, to insert the portion 4*a* for forming the neckingto the groove forming mold 50 from the other end 52. Then, the rear ends 55*c* of the pressure portions 55 formed in the taper portion 54 press the first convex 11 provided along the entire circumference toward the inside of the shoulder 3, so that the first convex 11 is recessed in the radial direction in a plurality of places that are at predetermined intervals in the circumferential direction. In this way, a plurality of grooves 10 extending in the inclined direction of the shoulder 3 are formed in the circumferential direction (see FIG 1B).

The lower end 10*e* of the groove 10 is formed by the leading end 55*b* of the pressure portion 55, and the upper end 10*d* of the groove 10 is formed by the rear end 55*c* of the pressure portion 55. In addition, the side wall 10*a* of the groove 10 is formed by the ascending wall surface 55*d* of the pressure portion 55, and the bottom portion 10*b* of the groove 10 is formed by the top portion 55*a* of the pressure portion 55.

The first convex 11 is recessed inward in the radial direction by the rear end 55*c* of the pressure portion 55 and the one end 51 of the top portion 55*a* of the top portion 55*a* of the pressure portion 55, and is also pressed to the inside of the cylindrical workpiece by the leading end 55*b* having a triangular shape in plan view, with the lower end of the shoulder 3 disposed at a top vertex of the triangle (an intersection ridge-line between the leading end 55*b* and the top portion 55*a*). In addition, among portions of the shoulder 3 other than the lower end, a line linking the recessed portion of the first convex 11 to the portion pressed by the one vertex of the leading end 55*b* is pressed by the top portion 55*a* to be recessed to the inside of the cylindrical workpiece, thereby forming the groove 10.

At this point, the line of the shoulder 3 is recessed by the top portion 55*a*, and a portion adjacent to the recessed portion in the circumferential direction is pressed to the inside of the cylindrical workpiece by the ascending side wall 55*d* such that the width of the recessed portion increases in the circumferential direction.

Figure 1C:
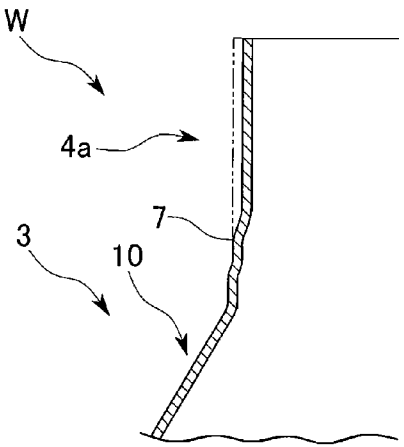
Figure 1D:
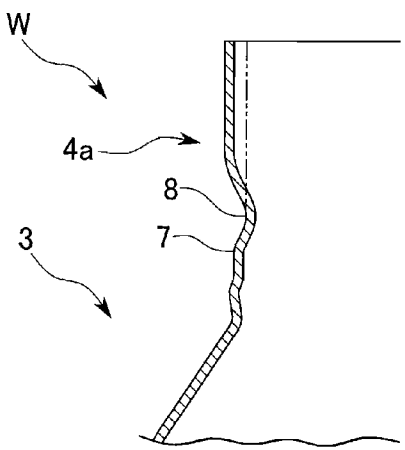

Then, after the disk 31 is rotated by a predetermined angle, the tool holding portion 40 is moved toward the workpiece holding portion 30 to perform a drawing process on a part of the portion 4*a* other than the lower end in the axial direction of the cylindrical workpiece, thereby reducing the diameter of the part. In this way, a second convex 7 that protrudes outward in the radial direction and is smoothly connected to the shoulder 3 is formed at the lower end of the portion 4*a* in the axial direction of the cylindrical workpiece (see FIG. 1C). Next, similarly, after the disk 31 is rotated by a predetermined angle, the tool holding portion 40 is moved toward the workpiece holding portion 30 to increase the diameter of a part (hereinafter, referred to as a 'large-diameter portion') of the portion 4*a* other than a portion of the second convex 7 extending from the upper end to the lower end in the axial direction of the cylindrical workpiece by a predetermined length, thereby forming the small-diameter portion 8 and a small-diameter portion of the protruding portion 6 (see FIG. 1D).

Similarly, after the disk 31 is rotated by a predetermined angle, the tool holding portion 40 is moved toward the workpiece holding portion 30 to reduce the diameter of a part of the large-diameter portion other than the lower end in the axial direction of the cylindrical workpiece, thereby forming the lower end of the large-diameter portion in the protruding portion 6. Then, for example, a screw forming process, a trimming process, and a curl forming process are sequentially performed on the cylindrical workpiece W having the bottom while repeating the intermittent rotation of the disk 31, thereby forming the bottle-shaped can 1 shown in FIG. 2. Then, the bottle-shaped can 1 is discharged from the bottle-shaped can manufacturing apparatus 20 by the discharge portion 34 shown in FIG. 7, and is then carried to the next stage.

As described above, according to the bottle-shaped can manufacturing method of this embodiment, the shoulder 3 is pressed to the inside of the cylindrical workpiece while the first convex 11 is recessed inward in the radial direction to form the groove 10. Therefore, it is possible to prevent a portion of the first convex 11 that is not recessed by the rear end 55*c* of the pressure portion 55 (the top portion 10*c*) from being recessed inward in the radial direction due to the deformation of the first convex 11 recessed inward in the radial direction (the side wall 10*a* and the bottom portion 10*b*).

That is, it is possible to make the portion of the first convex 11 that is not recessed (the top portion 10*c*) have resistance to pressure applied to the inside of the bottle-shaped can, that is, a protruding force toward the outside of the bottle-shaped can in the radial direction. In this way, it is possible to manufacture the bottle-shaped can 1 having the grooves 10 that are formed in the outer circumferential surface of the shoulder 3 in the concave shapes such that they are clearly viewed. As a result, it is possible to improve the quality of design of the bottle-shaped can 1.

Further, since the first convex 11 is pressed inward in the radial direction to form the grooves 10 in the shoulder 3, it is possible to easily form the grooves 10 without lowering the roundness of the neck 4. That is, in this embodiment, the first convex 11 is formed after a necking process. Therefore, even when the roundness of the portion 4*a* for forming the neck is lowered due to the necking process, it is possible to correct the lowered roundness and thus to prevent the lowering of the roundness of the portion 4*a*.

When the first convex 11 is pressed to the inside of the cylindrical workpiece, relatively low pressure is applied to the shoulder 30, starting from the recessed first convex 11, so that the groove 10 is formed from the upper end to the lower end of the shoulder 3 in the inclined direction. That is, it is possible to easily and accurately form the groove 10 and to prevent the body 2 from being bent when the groove 10 is formed, due to the alignment of metal crystals of the cylindrical workpiece W formed by a DI process.

When the groove 10 is formed, the first convex 11 can prevent metal forming the portion 4*a* for forming the neck from flowing to the shoulder 3 or into the groove 10, which makes it possible to form the groove 10 having a large depth and to prevent at least one of the portion 4*a* and the body 2 from being wrinkled.

Further, since the line of the shoulder 3 is pressed to form the groove 10, it is possible to form the groove 10 in a straight line in the inclined direction of the shoulder 3.

In this way, it is possible to form the bottle-shaped can 1 having a high-quality design.

Furthermore, since the width of the lower end 10*e* of the groove 10 gradually increases toward the lower end of the shoulder 3, it is possible to reliably prevent metal forming the body 2 from flowing to the shoulder 3 when the groove 10 is formed. In addition, since the depth of the groove 10 gradually decreases toward the lower end of the shoulder 3, that is, the displacement of the groove 10 decreases inward in the radial direction, it is possible to prevent the upper end of the body 2 in the axial direction of the cylindrical workpiece from being wrinkled in the axial direction when the groove 10 is formed. The same effects as described above are obtained from the upper end 10*d* of the groove 10. In particular, in this embodiment, since the leading end 55*b* and the rear end 55*c* of the pressure portion 55 of the mold 50 are formed in triangular shapes, it is possible to reliably obtain the above-mentioned effects.

In this embodiment, since the number of grooves 10 is in the range of 8 to 22 and the groove 10 is formed so as to satisfy the above-mentioned Expression, it is possible to adjust the gap between adjacent pressure portions 55 to a predetermined value in the mold 50 and thus to adjust the deformation of the first convex 11 by the pressure portion 55 that is used to press the first convex 11 to form the groove 10. Therefore, it is possible to form the grooves 10 in the entire shoulder 3 in the axial direction of the cylindrical workpiece and thus to form the top portions 10*c* that sharply protrude. As a result, it is possible to reliably form the bottle-shaped can 1 having a high-quality design.

Further, since the groove 10 is formed and then the second convex 7 is formed, the grooves 10 make it possible to correct the roundness of the portion 4*a* for forming the neck, even when the roundness of the portion 4*a* is lowered.

Furthermore, since the groove forming mold 50 is used to form the grooves 10, it is possible to form a plurality of grooves 10 in the entire circumferential surface of the shoulder 3 at once and thus to improve productivity. In addition, since a uniform load can be applied to the entire circumferential surface of the shoulder 3, it is possible to minimize a reduction in the roundness of the portion 4*a* for forming the neck.

Further, since the grooves 10 are formed under the conditions of the internal pressure in the range of 0.05 MPa to 0.70 MPa, it is possible to reliably prevent the body 2 from being bent when the grooves 10 are formed.

In this embodiment, ten types of bottle-shaped cans having different grooves (that is, grooves having different values of n, a1, a2, L2, and θ) are formed, and it is checked whether the groove 10 is clearly viewed due to the steep side walls 10*a* and the steep top portion 10*c* of the groove 10. FIG. 5 shows the check results. As can be seen from FIG. 5, when the number of grooves 10 is in the range of 8 to 22, a bottle-shaped can having a high-quality design is formed.

The technical scope of the invention is not limited to the above-mentioned embodiment, but various modifications and changes of the invention can be made without departing from the spirit and scope of the invention. For example, in the above-described embodiment, the grooves 10 are formed and then the second convex 7 is formed, but the invention is not limited thereto. After the second convex 7 is formed, the first convex 11 will be pressed to form the grooves 10. In this case, it is possible to improve the rigidity of the portion 4*a* for forming the neck against pressure applied when the grooves 10 are formed, and to prevent the roundness of the portion 4*a* from being lowered when the grooves 10 are formed. In addition, even when pressure applied to the shoulder 3 is transmitted to the portion 4*a* during the formation of the grooves 10, the second convex 7 makes it possible to prevent the portion 4*a* from being wrinkled due to the transmitted pressure.

The first convex 11 may be formed at only the lower end of the shoulder 3, but it may not be formed at the upper end of the shoulder 3. Then, the first convex 11 formed at the lower end of the shoulder 3 may be pressed inward in the radial direction to form the grooves 10. That is, the first convex (a thick portion) 11 protruding outward from the cylindrical workpiece may be formed on at least one of the upper end and the lower end of the shoulder 3, and a line linking the upper end to the lower end of the shoulder 3 in the inclined direction may be pressed to the inside of the cylindrical workpiece to form a plurality of grooves 10 extending in the inclined direction in the circumferential direction of the shoulder 3. In this case, the lower end of the line is pressed by the leading end 55*b* (mold surface) having a triangular shape, with one vertex of the leading end 55*b* (an intersection ridgeline between the top portions 55*a*) disposed at the top of the lower end of the line, and a point on the line where the first convex 11 is disposed is pressed inward in the radial direction.

Figure 11:
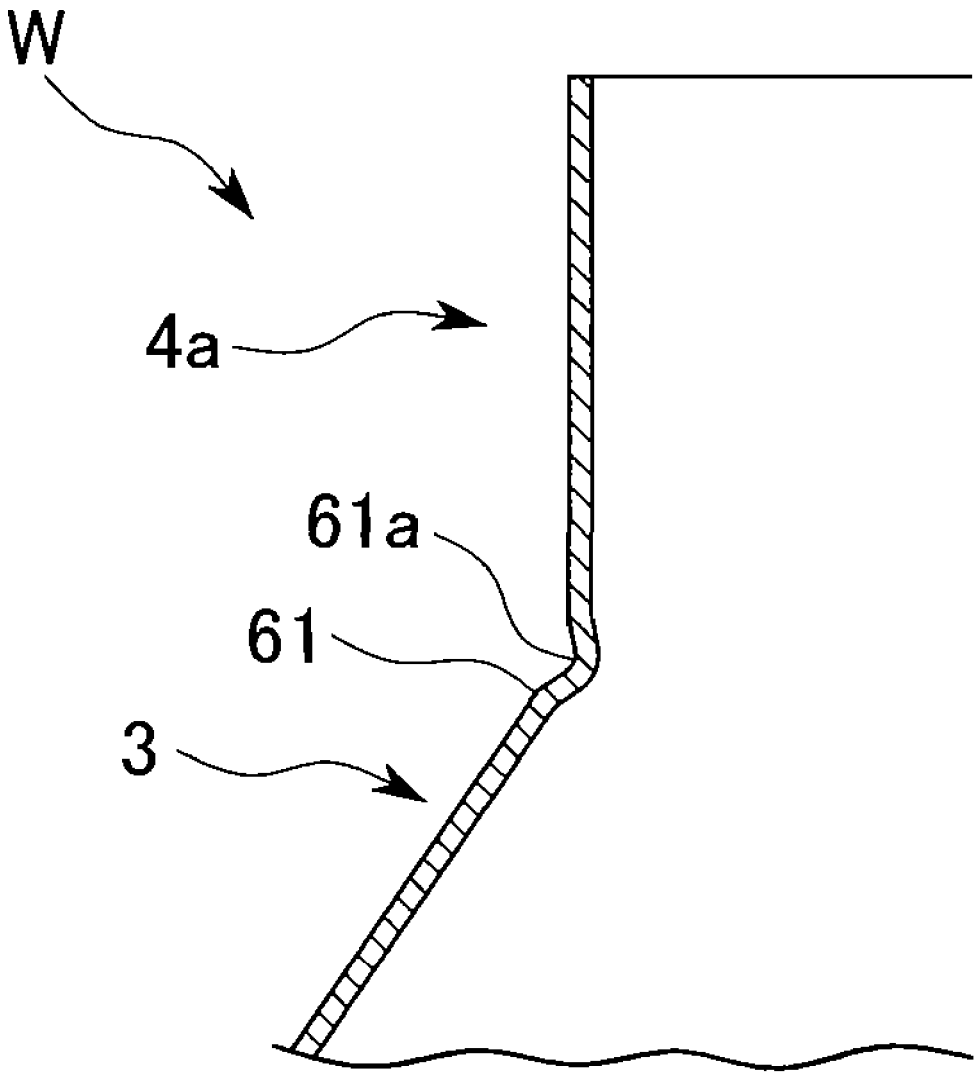
FIG. 11 is a partial sectional side view illustrating an opening portion of a cylindrical workpiece with a bottom after a first process of a bottle-shaped can manufacturing method according to another embodiment of the invention.

Further, in the above-described embodiment, as shown in FIG. 1A, the first convex 11 protrudes in the radial direction from both the shoulder 3 and the portion 4*a* for forming the neck, but the invention is not limited thereto. For example, as shown in FIG. 11, a connection portion 61*a* between the shoulder 3 and the portion 4*a* for forming the neck may be recessed inward in the radial direction, so that the upper end of the shoulder 3 in the axial direction of the cylindrical workpiece protrudes outward in the radial direction from the connection portion 61*a*. The upper end of the shoulder 3 in the axial direction of the cylindrical workpiece may be a first convex 61. In this case, similar to the above-described embodiment, the first convex 61 may be pressed inward in the radial direction to form the grooves 10.

The invention claimed is:

1. A method of manufacturing a bottle-shaped can including a body having a large diameter, a shoulder that is continuously connected to an upper end of the body in an axial direction of the body and is tapered upward, a neck that is continuously connected to an upper end of the shoulder in the axial direction and extends upward, and a cap that is engaged with a male screw formed on the neck, comprising:

performing a necking process on an opening portion of a cylindrical workpiece with a bottom and the body several times to form the body, the shoulder, and a portion for forming the neck that is continuously connected to the upper end of the shoulder in the axial direction and extends upward;

forming a first convex in at least one of a connection portion between the shoulder and the portion for forming the neck and a connection portion between the shoulder and the body such that the first convex protrudes outward in a radial direction from the entire circumference of the connection portion;

pressing a line linking the upper end to a lower end of the shoulder in a direction in which the shoulder is inclined to an inside of the bottle-shaped can to form, in a circumferential direction of the shoulder, a plurality of grooves extending in an inclined direction;

pressing a lower end of the line with a mold surface having a triangular shape, with one vertex of the triangular mold surface disposed at the lower end of the line; and pressing a point on the line where the first convex is disposed to be recessed inward in the radial direction.

2. The method of manufacturing a bottle-shaped can in accordance with claim 1, wherein the first convex is formed in the connection portion between the shoulder and the portion for forming the neck, and the line links the recessed portion of the first convex to the portion pressed by the one vertex of the triangular mold surface in the direction in which the shoulder is inclined.

3. The method of manufacturing a bottle-shaped can in accordance with claim 1, wherein after the shoulder and the portion for forming the neck are formed, pressing a portion from the upper end of the shoulder to the lower end of the portion for forming the neck inward in the radial direction such that the width of the portion is reduced, thereby forming the first convex in the connection portion between the shoulder and the portion for forming the neck, and pressing the shoulder to the inside of the body while the first convex is being pressed inward in the radial direction, thereby forming the grooves.

4. The method for manufacturing a bottle-shaped can in accordance with claim 1, wherein a cylindrical mold having an inner circumferential surface that is formed substantially in the same shape as that of the shoulder and a plurality of pressure portions, each extending substantially in the inclined direction of the shoulder, that are formed in the circumferential direction on the inner circumferential surface so as to protrude inward in the radial direction is arranged so as to coaxially face the opening portion of the cylindrical workpiece with the bottom, and moving the mold and the cylindrical workpiece with the bottom close to each other in the axial direction of the cylindrical workpiece with the bottom such that the opening portion of the cylindrical workpiece with the bottom is inserted into the mold and the pressure portions are pressed against the shoulder, thereby forming in the circumferential direction the plurality of grooves satisfying the following Expression:

$$L1=h/\cos\alpha,$$

$$a1=2\cdot r\cdot sin(360°/(2\cdot n)),$$

$$a2=2\cdot\sin(360°/(2\cdot n))\cdot(r-h\cdot\tan\alpha),$$

$$L2=a2\cdot L1/(a1-a2), \text{ and}$$

$$\theta=2\cdot arc\sin(a2/2\cdot L),$$

wherein L1: the length of the shoulder in the inclined direction, a1: the width of a lower end of the groove in the axial direction of the bottle-shaped can, a2: the width of an upper end of the groove in the axial direction of the bottle-shaped can, L2: the distance between the upper end of the shoulder in the axial direction of the bottle-shaped can and an intersection point between two extension lines of both ends of the groove in the circumferential direction that extend upward in the axial direction of the bottle-shaped can, n: the number of grooves ($8 \leqq n \leqq 22$), r: the radius of an outer circumferential surface of the body, h: the length of the shoulder in the axial direction of the bottle-shaped can, and α: an angle formed between the axis of the bottle-shaped can and the outer circumferential surface of the shoulder, and θ: an angle formed by extending the two ends of the groove upward in the axial direction.

5. The method of manufacturing a bottle-shaped can in accordance with claim 1, wherein after the grooves are formed, performing a drawing process on a part of the portion for forming the neck other than the lower end in the axial direction to reduce the diameter of the part, thereby forming a second convex protruding outward in the radial direction at the lower end in the axial direction, the lower end in the axial direction being a part of the portion for forming the neck.

6. The method of manufacturing a bottle-shaped can in accordance with claim 1, wherein after the first convex is formed, performing a drawing process on a part of the portion for forming the neck other than the lower end in the axial direction to reduce the diameter of the part, thereby forming a second convex protruding outward in the radial direction at the lower end in the axial direction, the lower end in the axial direction being a part of the portion for forming the neck, and thereafter the grooves are formed.

7. The method of manufacturing a bottle-shaped can in accordance with claim 1, wherein the grooves are formed under the condition that an internal pressure of the bottle-shaped can is in the range of 0.05 MPa to 0.70 MPa.

8. A bottle-shaped can comprising:

a body that has a large diameter;

a shoulder that is continuously connected to an upper end of the body in an axial direction of the body and is tapered upward;

a neck that is continuously connected to an upper end of the shoulder in the axial direction and extends upward; and a cap that is engaged with a male screw formed on the neck, wherein the bottle-shaped can is formed by the bottle-shaped can manufacturing method in accordance with to claim 1, a portion of a groove other than a lower end in a direction in which the shoulder is inclined is formed in a V shape in sectional view in a direction orthogonal to the axis of the bottle-shaped can, the lower end of the groove in an inclined direction has a triangular shape as viewed from the outside in a radial direction, and one of three vertexes of the triangle is disposed at an upper end in the inclined direction and a lower end of the V-shaped bottom in the inclined direction, and the remaining two vertexes are disposed at both ends of a lower end of the shoulder in the inclined direction.

* * * * *